US009297185B2

(12) United States Patent
Lasaroff

(10) Patent No.: US 9,297,185 B2
(45) Date of Patent: Mar. 29, 2016

(54) PADLOCK

(71) Applicant: Abloy Oy, Joensuu (FI)

(72) Inventor: Jukka Lasaroff, Joensuu (FI)

(73) Assignee: ABLOY OY, Joensuu (FI)

( * ) Notice: Subject to any disclaimer, the term of this patent is extended or adjusted under 35 U.S.C. 154(b) by 34 days.

(21) Appl. No.: 14/167,439

(22) Filed: Jan. 29, 2014

(65) Prior Publication Data

US 2015/0211261 A1 Jul. 30, 2015

(51) Int. Cl.

| | |
|---|---|
| ***E05B 67/06*** | (2006.01) |
| ***E05B 67/02*** | (2006.01) |
| *E05B 9/08* | (2006.01) |
| *E05B 67/24* | (2006.01) |
| *E05B 63/00* | (2006.01) |

(52) U.S. Cl.

CPC ..... *E05B 67/02* (2013.01); *E05B 9/084* (2013.01); *E05B 9/086* (2013.01); *E05B 63/0056* (2013.01); *E05B 67/06* (2013.01); *E05B 67/24* (2013.01); *Y10T 70/446* (2015.04)

(58) Field of Classification Search

CPC ..... E05B 67/24; E05B 9/084; E05B 9/086; E05B 63/0056; E05B 67/06; E05B 67/02; Y10T 70/446

USPC ..... 70/31, 35, 367–371, 386, 38 A

See application file for complete search history.

(56) References Cited

U.S. PATENT DOCUMENTS

| | | | | | |
|---|---|---|---|---|---|
| 206,327 | A * | 7/1878 | Hillebrand | 70/38 A |
| 4,776,187 | A * | 10/1988 | Evans et al. | 70/38 A |
| 4,946,130 | A * | 8/1990 | Kooiman | 251/95 |
| 5,121,618 | A * | 6/1992 | Scott | 70/367 |
| 5,377,511 | A * | 1/1995 | Meckbach | 70/38 A |
| 6,766,673 | B2 * | 7/2004 | Gast et al. | 70/38 A |
| 7,856,855 | B2 * | 12/2010 | Fantl et al. | 70/39 |
| 2004/0231379 | A1 * | 11/2004 | Yu | 70/491 |
| 2013/0014548 | A1 * | 1/2013 | Fan et al. | 70/35 |

* cited by examiner

*Primary Examiner* — Suzanne Barrett
*Assistant Examiner* — Morgan McClure
(74) *Attorney, Agent, or Firm* — Muncy, Geissler, Olds & Lowe, P.C.

(57) ABSTRACT

In the invention the lock cylinder of the padlock can be released from the body of the padlock without releasing the cam member or locking balls. In the invention the cam member remains in the body of the padlock because at least one locking ball is against the cam member keeping it at place.

16 Claims, 7 Drawing Sheets

PADLOCK

BACKGROUND OF THE INVENTION

1. Field of the Invention

The present invention relates to a padlock with a releasable lock cylinder inside the body of the padlock. The lock cylinder is releasable from the lock body by using a control key.

2. Brief Description of the Related Art

A very common padlock comprises a lock cylinder inside its body. The structure is such kind that the cylinder cannot be removed from the body. Another padlock type has a structure that allows the removing of the lock cylinder when the padlock has been opened with a key. Yet another type of padlocks have been designed to be useable with a normal key for a normal use and with a control key for removing the lock cylinder. U.S. Pat. No. 4,776,187 describes this kind of padlock.

The lock body of the embodiment of U.S. Pat. No. 4,776,187 is divided into two parts. The shackle of the padlock is connected to the first part. The second part comprises a cavity for a lock cylinder, a cam member, and one locking ball. When using the padlock normally, a normal key is used for opening the padlock by turning the key clockwise. A control key is used for releasing the cylinder from the lock body by turning the control key counter clockwise. The turning of the control key makes it possible to separate the parts of the lock body. The separation in turn allows the removal of the cam member, the locking ball and the lock cylinder away from the second part. In this way the cylinder can be changed to a new one, and the old cylinder can be maintained. The control key is needed for releasing the lock cylinder, because it is desired that the user having the normal key do not have an access to change the lock cylinder. In this way only a limited number of maintenance persons can change and maintain the lock cylinder.

So, when the cylinder lock is taken away from the lock body, the cam member and the other of the locking balls are taken away as well. These parts are easy to lose when taking out of the lock. The padlocks are used at a number of different places. The places are often distance locations, so the cylinders are taken away there where the padlocks are. Lighting conditions of the locations, such as warehouses and storage containers, are often poor. So, it is very easy to drop small parts like the cam members and the locking balls onto the ground where they get lost into the underbrush, sand, roll into a sewer hole of a warehouse area, and so on. Therefore a maintenance man should have spare parts with him, which creates additional costs. So when changing the lock cylinder of the padlock the maintenance man must be careful.

BRIEF SUMMARY OF THE INVENTION

The aim of the invention is to provide a solution to the above said problem. In the invention the lock cylinder of the padlock can be released from the body of the padlock without releasing the cam member or locking balls. The invention is achieved in a way described in the independent claim. The dependent claims illustrate different embodiments of the invention.

In the solution according to the invention, a padlock has a body, and a shackle that is moveable fixed to the body. The body has sockets for legs of the shackle, locking balls, first cavities for the locking balls, a cam member, a second cavity for the cam member, a lock cylinder and a third cavity for the lock cylinder. The locking balls are in the first cavities that are in connection with the sockets. The cam member in the second cavity is in connection with the locking balls, and the lock cylinder is in the third cavity. The cam member has unlocking cuts for the locking balls and a cylindrical basic form that has a first end and a second end. An inner part of the lock cylinder is turnable by a first key from a first position to a second position, and turnable by a second key from said first position to a third position. The lock cylinder is releasable from the body by turning the second key from the first position to the third position.

The cam member further comprises a circle groove on its surface in a vicinity of the first end providing a ridge at the first end. The unlocking cuts provide parts of the circle groove. The cam member has also second cuts for the locking balls beside the unlocking cuts, installation grooves at the ridge, and a connection formation at the second end of the cam member. The cam member is in functional connection with the lock cylinder through the connection formation. The locking balls are in the circle groove and beside the ridge keeping the cam member in the second cavity even if the lock cylinder is released from the body.

BRIEF DESCRIPTION OF THE DRAWINGS

In the following, the invention is described in more detail by reference to the enclosed drawings, where.

DETAILED DESCRIPTION OF THE PREFERRED EMBODIMENTS

Figure 1:
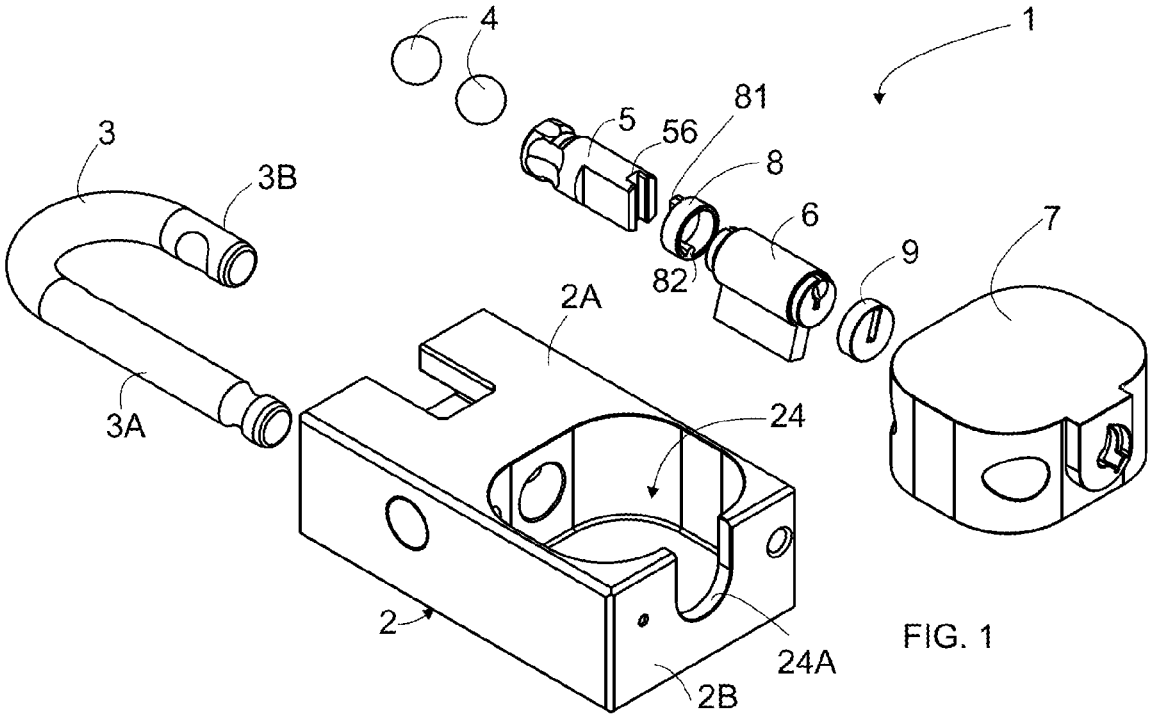
FIG. 1 illustrates an example of an embodiment of the invention as an explosive view.
Figure 5:
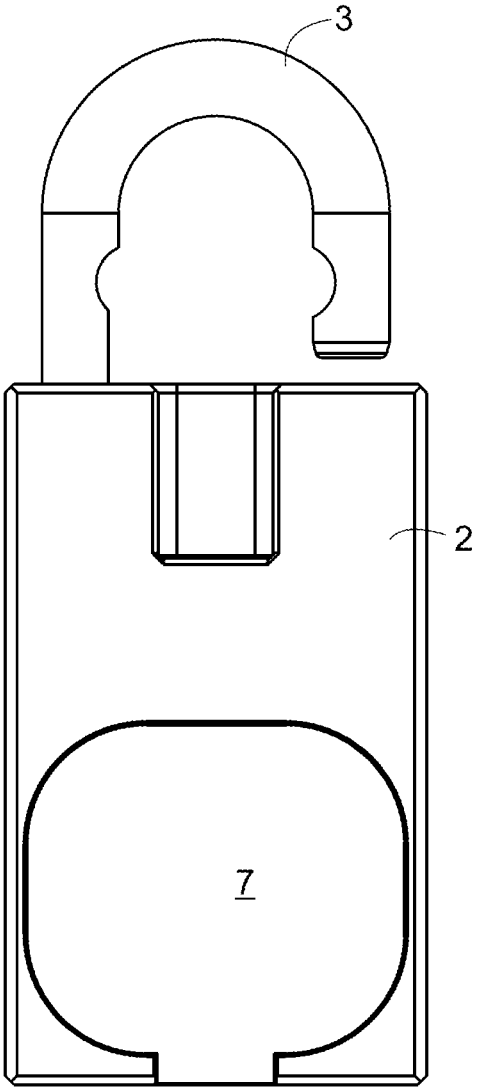
FIG. 5 illustrates the embodiment of FIG. 1 from the front view.
Figure 6:
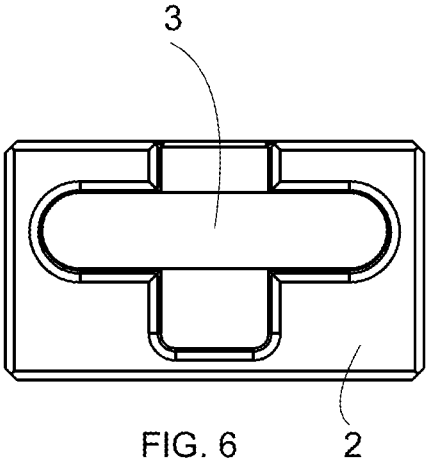
FIG. 6 illustrates the embodiment of FIG. 1 from the top.

FIG. 1 illustrates an example of an embodiment of the invention as an explosive view. A padlock 1 of the embodiment of FIG. 1 comprises a body 2, and a shackle 3 that is moveable fixed to the body. The body has sockets 21A, 21B for legs 3A, 3B of the shackle. The sockets can be seen more clearly in FIGS. 9 and 10. The padlock further comprises locking balls 4, first cavities 22 for the locking balls, a cam member 5, a second cavity 23 for the cam member, a lock cylinder 6 and a third cavity 24 for the lock cylinder. The first and second cavities can be seen in FIGS. 9 and 10. The locking balls 4 are in the first cavities 22 that are in connection with the sockets 21A, 21B. The cam member 5 in the second cavity is connectable with the locking balls and the lock cylinder 6 in the third cavity 24. The padlock can also comprise a bore protection 9 against drilling through a key hole. The shackle has cuts for the locking balls. FIG. 5 shows the padlock in an unlocked state. FIG. 6 is a top view of the padlock. As can be seen the body 2 may have protective sides that protect the shackle when the padlock is locked.

Figure 2:
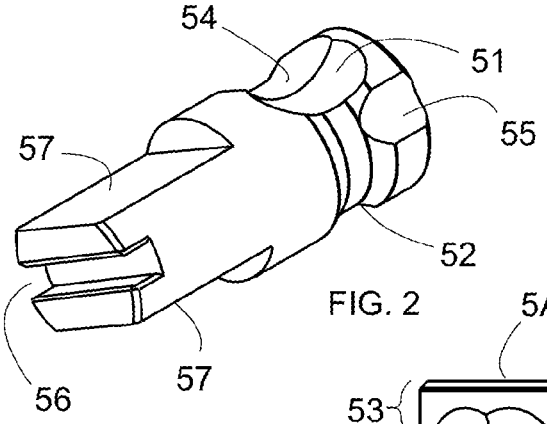
FIGS. 2-4 illustrate an example of a cam member of the inventive padlock.
Figure 4:
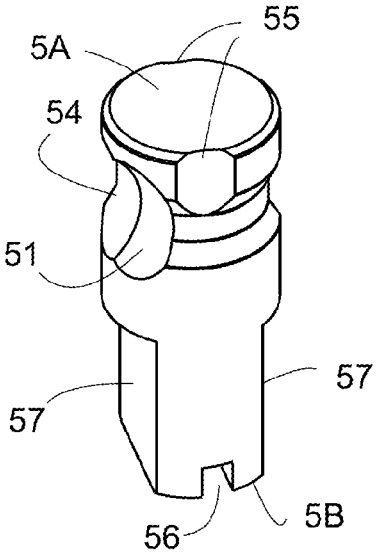
Figure 3:
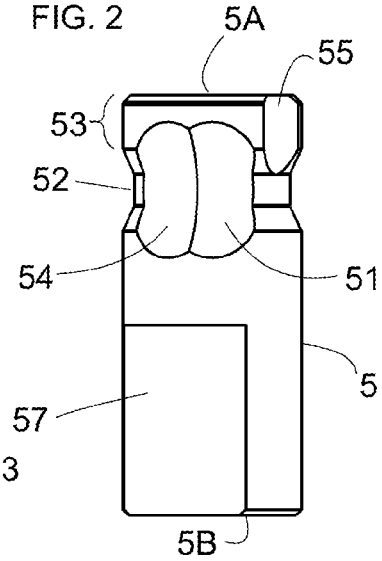

As can be seen the embodiment of FIG. 1 comprises also a second body 7 that is accommodated in the third cavity 24 of the body 2. The second body has a space 71 for the lock cylinder 6 and a slot 72 on a side of the second body 7. The slot extends to the space 71, and is narrower than the space. The space and a part 72A of the slot accommodate the lock cylinder. FIGS. 11-15 show the second body from different sides. The cam member, illustrated also in FIGS. 2-4, has unlocking cuts 51 for the locking balls 4 and a cylindrical basic form that has a first end 5A and a second end 5B, The inner part of the lock cylinder is turnable in a known way by a first key from a first position to a second position, and turnable by a second key from said first position to a third position. The first key is for a normal use to unlock and lock the padlock. The second key is for maintenance of the padlock. The second key is also called control key in this context. The lock cylinder 6 is releasable from the body by turning the control key from the first position to the third position. The control key may be used for normal use as well. The first position of the keys and the inner part of the clock cylinder is the position wherein the padlock is locked and the key can be inserted into the padlock for opening it. The second position is the position, where the padlock is unlocked with the normal key, i.e. the first key. The third position refers to the position of the control key, i.e. the second key, and the inner part of the lock cylinder wherein the lock cylinder can be removed from the body of the padlock.

The cam member 5 further comprises a circle groove 52 on its surface in a vicinity of the first end 5A providing a ridge 53 at the first end. The unlocking cuts 51 are parts of the circle groove 52 as can seen in the figures. The cam member has also second cuts 54 for the locking balls beside the unlocking cuts 51, installation grooves 55 at the ridge 53, and a connection formation 56 at the second end 5B of the cam member. The cam member 5 is in functional connection with the lock cylinder 6 through the connection formation. The locking balls 4 are in the circle groove 52 and beside the ridge 53 keeping the cam member in the second cavity 23 even if the lock cylinder is released from the body 2. The installation grooves 55 are used when the cam member is installed in the second cavity. The grooves make it possible to push the cam member inside so that the locking balls do not provide a hindrance. After the cam member has been pushed into the second cavity, the cam member is turned in such a way that the ridge against the locking ball/s keeps the cam member in the second cavity under normal use of the padlock or when removing to lock cylinder from the body 2. The ridge has also uncut sections wherein there are no cuts for the locking balls or for installation. The uncut sections are against the locking balls when the padlock is locked. The uncut sections provide a better strength and security than the other sections having above said cuts.

Figure 8:
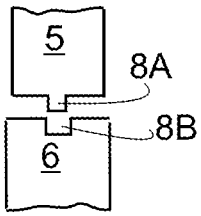
FIG. 8 shows an example of the connection between the lock cylinder and the cam member.

The lock cylinder itself may have a counter formation for the connection formation 56 of the cam member having a shape of a projection or a recess. FIG. 1 shows an embodiment where connection formation is the recess. FIG. 8 illustrates an opposite embodiment wherein the connection formation is the projection 8A of the cam member and the counter formation is the recess 8B. In order to use a normal lock cylinder, the padlock can comprise a connection part 8 between the lock cylinder 6 and the second end of the cam member 5. In this alternative the connection part has a counter formation 81 for the connection formation of the cam member, providing a projection or a recess. The connection part has also formations 82 for the connection with the lock cylinder.

So, when the inner part (inner cylinder) of the lock cylinder 6 is turned by either the first key or the second key, the counter formation that is either integral part of the lock cylinder or a part of said connection part 8 transmits the turning of the key and the inner part to the cam member 5 through the connection formation 56 that is against the counter formation 81. The first key turns the inner part and the cam member normally. The second key is arranged to turn the inner part and the cam member between 25-40 degrees from the first position to the third position for releasing the lock cylinder from the body. 30 degrees has been found to be a good turning angle for turning to the third position. When the cam member has been turned by the normal key (to the second position), the unlocking cuts 51 are against the locking balls. When the cam member has been turned by the control key (to the third position), the seconds cuts 54 are against the locking balls.

A part of the space 71 of the second body 7 accommodates the second end 5B of the cam member that comprises side cuts 57 so that the second end of the cam member fits into another part 72B of the slot beside the space 71, if the inner part of lock cylinder is turned from the first position to the third position. As already said, the inner part of the lock cylinder is functionally connected with the second end of the cam member. So, in the third position, the lock cylinder can be released from the lock body, because the cam member fits to the side slot 72, and therefore the cam member does not provide an obstacle. The lock cylinder is removed with a second body from the lock body. It should be noted that, if the longer leg 3A of the shackle 3 is in a bore 73 of the second body, it also prevents the removing of the second body and the lock cylinder. Therefore in an embodiment wherein the second body comprises a bore 73 for one of the legs of the shackle and the leg is in the bore when the padlock is locked, the padlock must be open and the shackle pulled away from the bore as well in order to take the lock cylinder out from the body.

As can be seen the third cavity 24 is open on a side 2A of the body in the embodiment of FIG. 1. The third cavity may have a side slot 24A to a bottom 2B of the body, and the second body 7 has a side projection 74 that fits to the side slot 24A. The side projection comprises a hole 75 for said keys.

Figure 7:
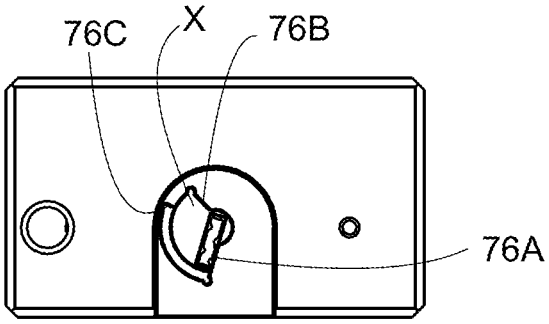
FIG. 7 illustrates the embodiment of FIG. 1 from the bottom view when a key is turned to the second position.

FIG. 7 shows that the hole for the keys comprises shapes 76A, 76B, 76C for providing turning areas for the keys. The key is at the second position in FIG. 7 so the key is the first key. X indicates the third position where to the second key can be turned from the first position. Shape 76C provides a block for the first key if someone tries to turn it to the third position. The first position is between the second and third position. The keys and the lock cylinder of this embodiment are known already, for example from U.S. Pat. No. 4,776,187.

Figure 9:
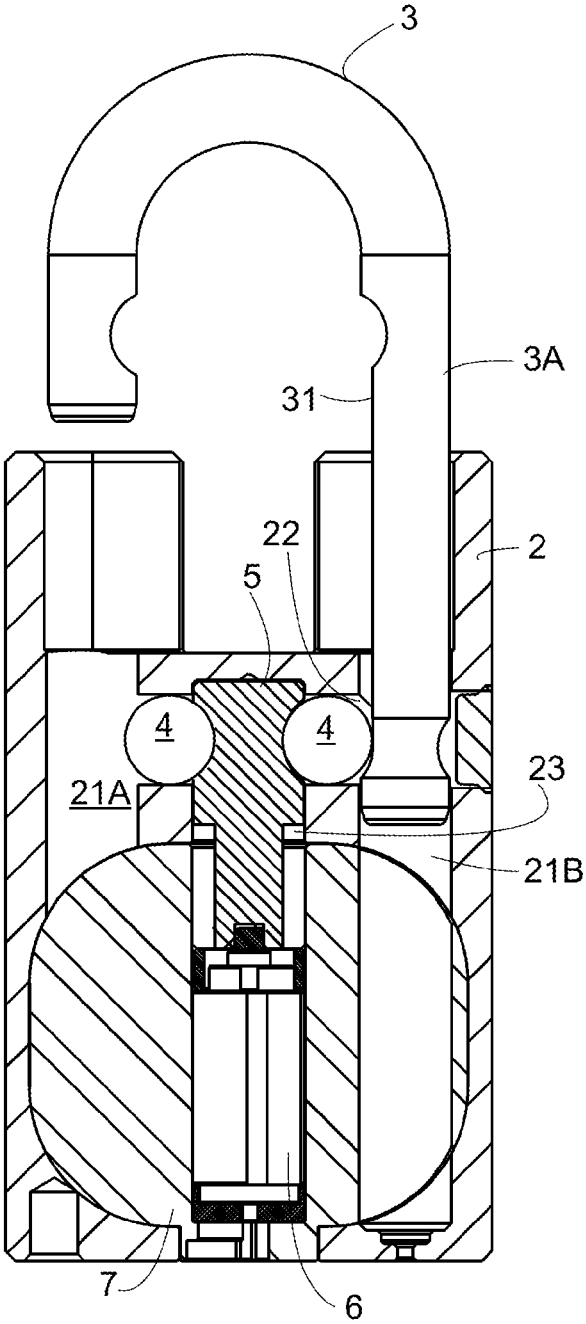
FIGS. 9-10 illustrate section views of the embodiment of FIG. 1 in a locking and an unlocking state.
Figure 10:
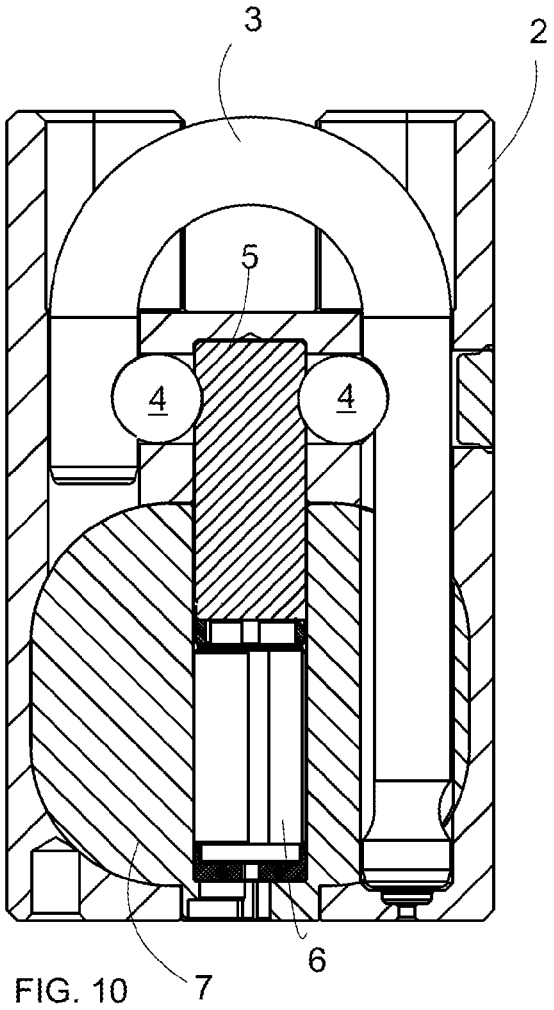
Figure 11:
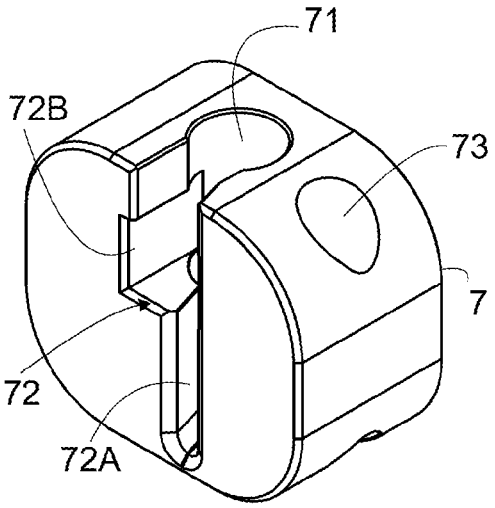
FIGS. 11-15 illustrate an example of the second body of the embodiment of FIG. 1.
Figure 12:
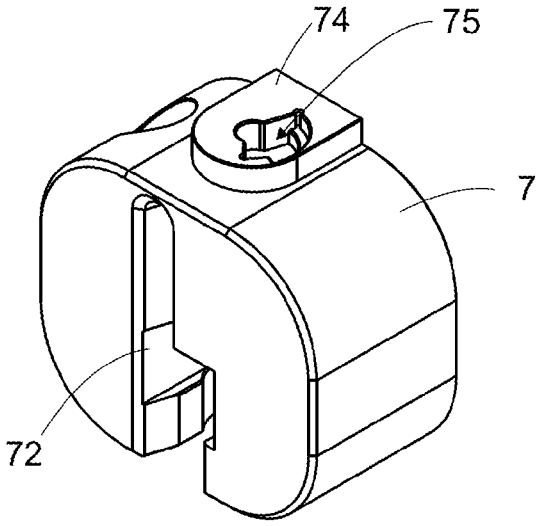
Figure 13:
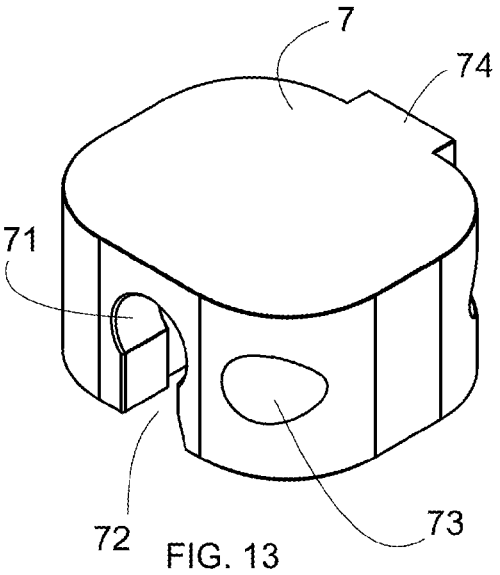
Figure 14:
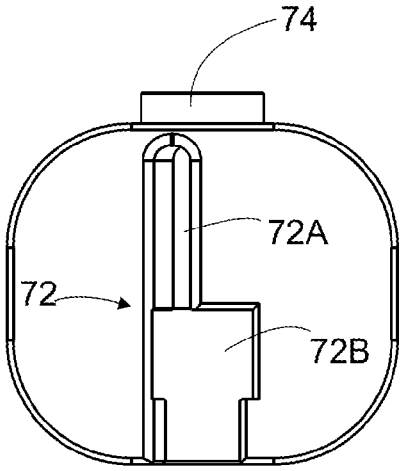
Figure 15:
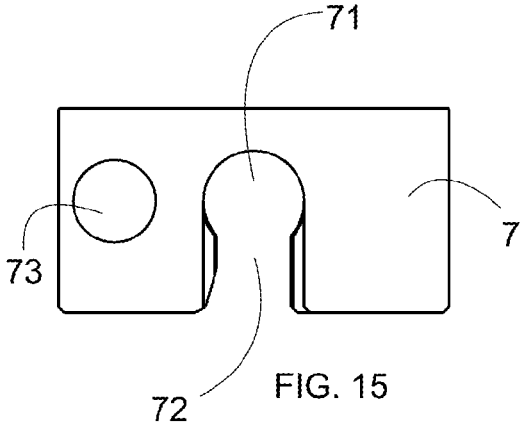

FIG. 9 shows the padlock 1 when it is unlocked by the second key. The inner part has been turned to the third position wherein the side cuts 57 of the cam member 5 can fit to the side slot 72 of the second body. In addition, the shackle 3 has been pulled out the body 2 as much as possible. As can be noted, the cam member 5 and the longer leg 3A of the shackle do not prevent the removing of the second body and the lock cylinder out of the body in FIG. 9 situation. It can also be noted that the longer leg of the shackle has a side cut 31 along the leg. The unlocking cuts 51 and the second cuts 54, and the side cut 31 of the leg have been made so that the locking ball between the longer leg of the shackle and the cam member is against the cam member 5 and the leg 3A at all positions of the shackle and the cam member when the padlock is used normally, or when the lock cylinder is removed from the body of the padlock. So, the cam member 5 and the other locking ball 4 remain in the padlock and do not drop away. The first cavity beside the shorter leg of the shackle has been formed so that the locking ball in the first cavity does not drop to the socket of the shorter leg. FIG. 10 shows the padlock when it is locked.

So, the lock cylinder can be removed from the body, by turning the second key from the first position to the third position. In embodiments wherein the longer leg of the shackle also keeps the lock cylinder in the body, the lock can be opened first by turning to the second position and then turning to the other direction to the third position. So the second key can have the functionality of the first key. In this embodiment and in the next embodiment the clockwise direction is the turning direction from the first position to the second position, and the counter clockwise direction is the turning direction from the first position to the third position. However the turning directions can also be opposite if the lock cylinder is designed that way. The lock cylinder can be placed into the body of the padlock, by doing the steps of the removal backwards. In other words, the clock cylinder is turned to the third position by the second key, and then it is turned form the third position to the first position for keeping the lock cylinder (and the second body) in the body of the padlock.

Figure 16:
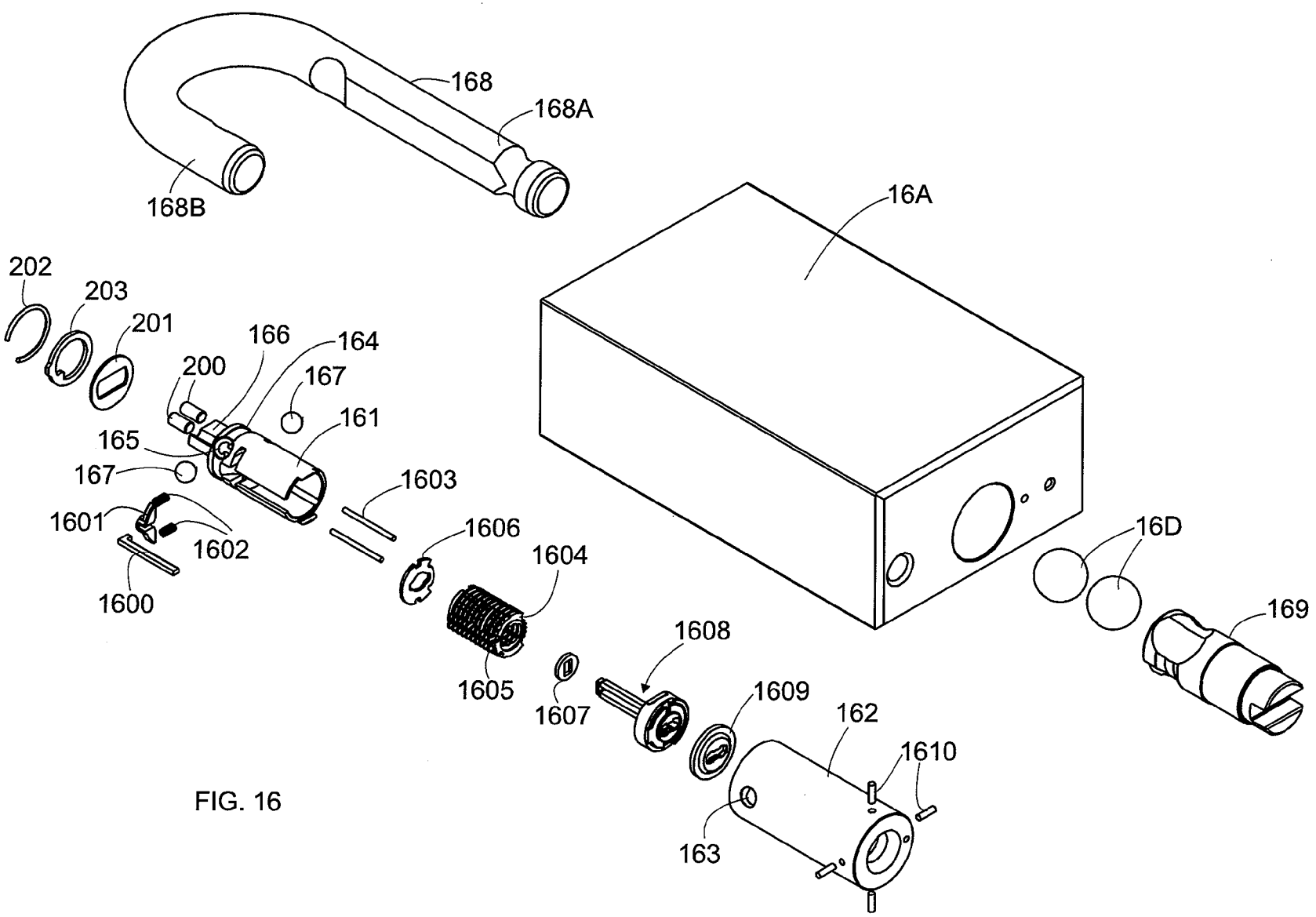
FIG. 16 illustrates another embodiment of the invention as an explosive view.
Figure 17:
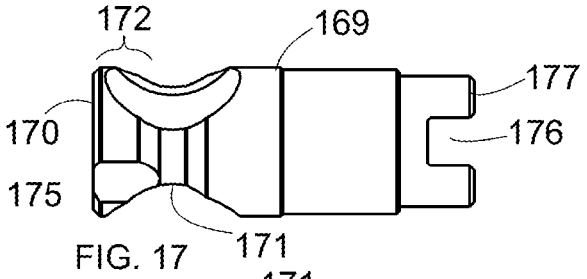
FIGS. 17-20 illustrate another example of a cam member of the inventive padlock.
Figure 18:
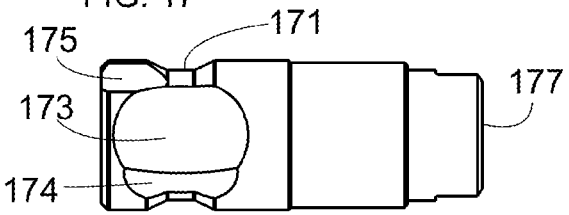
Figure 19:
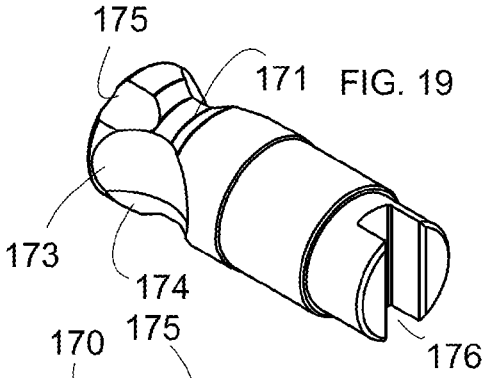
Figure 20:
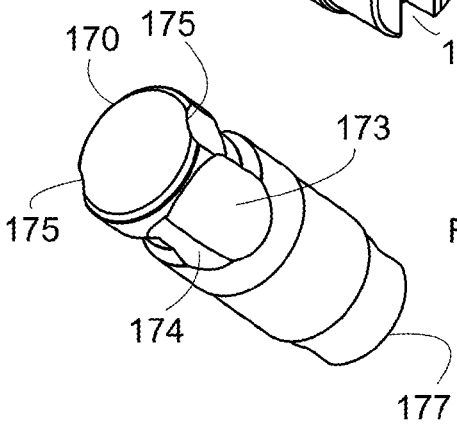

FIG. 16 shows another embodiment 16 of the inventive padlock. In this embodiment the lock cylinder comprises an inner cylinder 161, being said inner part, and an outer cylinder 162. The outer cylinder has two holes 163, and the inner cylinder has a peripheral groove 164 around its circle surface and two bores 165 on the peripheral groove. The cylinder lock further comprises a counter formation 166 for the connection formation of the cam member 170 and two balls 167 in the peripheral groove 164. The counter formation 166 is in connection with the inner cylinder 161, and the balls 167 are between the inner cylinder and the outer cylinder.

The lock cylinder of the embodiment of FIG. 16 comprise also other parts like a locking bar 1600, a locking bar plate 1601 and its springs 1602, retainer bars 1603, tumblers 1604, intermediate discs 1605, a so called zero dics 1606, a filler dics 1607, a rotation limiter arrangement 1608, and a bore protection plate 1609. These other parts are known parts. The outer cylinder may also comprise protection pins 1610.

Figure 26:
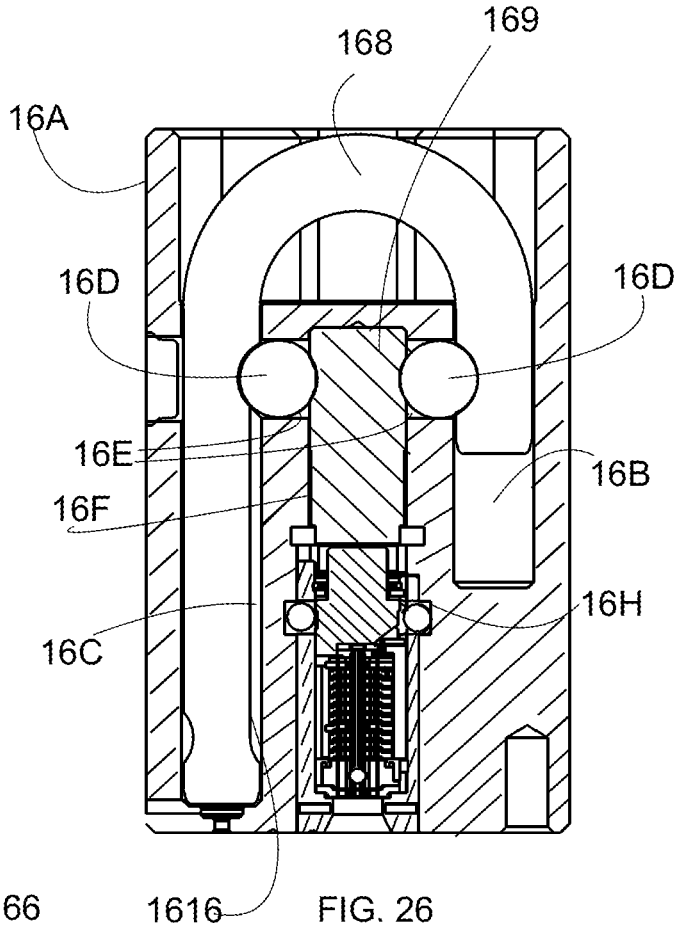
FIG. 26 illustrates a section view of the embodiment of FIG. 15.

FIG. 16 illustrates the embodiment as an explosive view. FIG. 26 shows a section view of this embodiment. A padlock 16 of the embodiment of FIG. 16 comprises a body 16A, and a shackle 168 that is moveable fixed to the body. The body has sockets 16B, 16C for legs 168A, 168B of the shackle. The padlock further comprises locking balls 16D, first cavities 16E for the locking balls, a cam member 169, a second cavity 16F for the cam member, a lock cylinder 161, 162 and a third cavity 16G for the lock cylinder.

The locking balls 16D are in the first cavities that are in connection with the sockets. The cam member in the second cavity is in connection with the locking balls and the lock cylinder in the third cavity.

The third cavity has the second circle groove 16H on its surface. The balls 167 of the lock cylinder are in the holes 163 of the outer cylinder 162 and partly in the second circle groove 164 when the inner cylinder 161 is in the first position or in the second position. The balls are moveable to the bores 165 away from the second circle groove 16H when the lock cylinder is in the third position, in which case the lock cylinder can be removed from the third cavity and the body 16A of the padlock. As can be seen the balls partly in the second circle groove keeps the lock cylinder in the body of the padlock.

Figure 27:
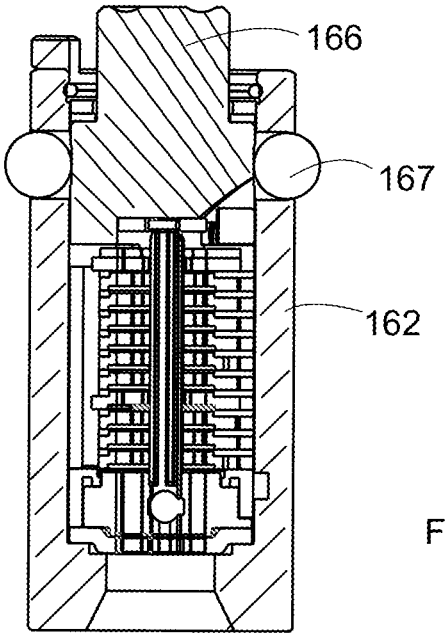
FIG. 27 illustrates yet another section view of the embodiment of FIG. 20.

The lock cylinder can further comprise two pins 200 and two installation holes 210 on a bottom of the lock cylinder. See FIGS. 22, 23 and 25. The installation holes extend from the bottom to the bores 165, and the pins 200 are through the installation holes to the bores. This arrangement is for manufacturing the lock cylinder. The balls 167 are in the bores 165 when the outer cylinder 162 and the inner cylinder 161 are put together. The pins are put into the installation holes and into bores 165 in order that balls 167 move towards the holes 163 of the outer cylinder and do not be entirely in the bores 165. See FIG. 24 that illustrates the lock cylinder when the second key is turned to the third position. FIG. 27 shows a section view of the lock cylinder when balls keep the lock cylinder in the body.

The lock cylinder further comprises a plate 201 covering at least partly the installation holes i.e. the second holes, and a fastener 202 for fixing the plate with the bottom of the inner cylinder. The plate keeps the pins in the holes. Also in this embodiment the counter formation 166 can be formed in such a way that it comprises recess.

Figure 22:
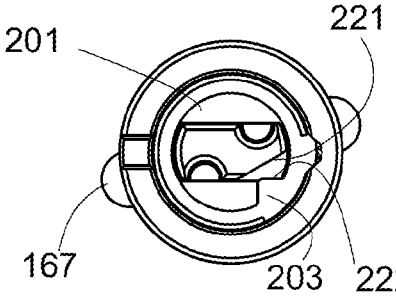
FIG. 22 illustrates the lock cylinder of FIG. 20 form the top view.

The inner cylinder may further comprise a limiter ring 203 for limiting rotation of the inner cylinder in relation to the outer cylinder. It the rotation of the inner cylinder is not arranged in another way, the limiter ring provides this function. In this embodiment the rotation is limited to 30 degrees as can be seen in FIG. 22. A surface 221 touches against the another surface 222 of the limiter ring when turning the second key form the first position to the third position.

The cam member 169 of the embodiment of FIG. 16, showed also in FIGS. 17-20, comprises the same features as the cam member of FIG. 1. A circle groove 171 is on its surface in a vicinity of the first end 170 providing a ridge 172 at the first end. The unlocking cuts 173 are parts of the circle groove 171. The cam member has also second cuts 174 for the locking balls beside the unlocking cuts, installation grooves 175 at the ridge 172, and a connection formation 176 at the second end 177 of the cam member. The cam member is in functional connection with the lock cylinder through the connection formation. The locking balls are in the circle groove and beside the ridge keeping the cam member in the second cavity even if the lock cylinder is released from the body 16A. The installation grooves are used as described above.

Figure 23:
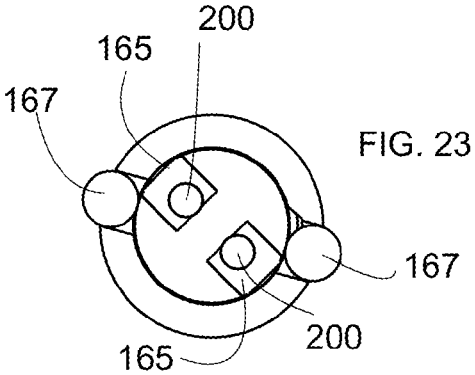
FIG. 23 illustrates a section view of FIG. 20 form the top view.
Figure 21:
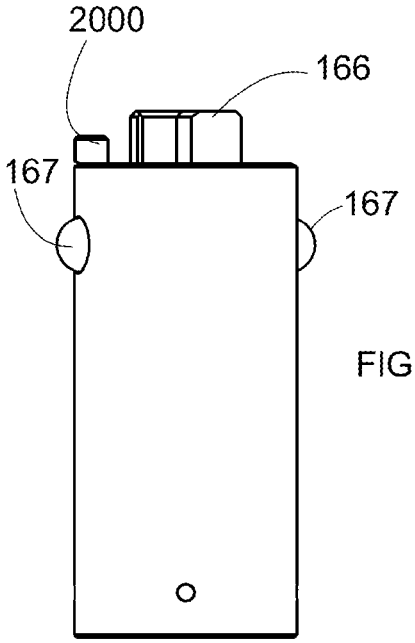
FIG. 21 illustrates an example of a lock cylinder of an inventive embodiment.
Figure 24:
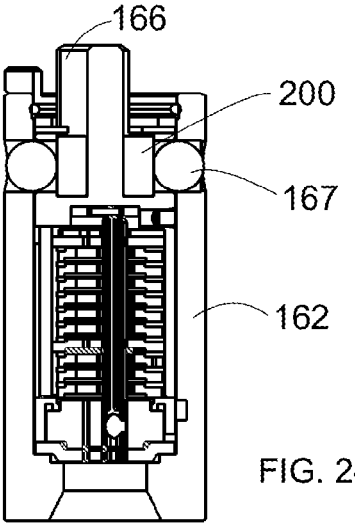
FIG. 24 illustrates another section from the embodiment of FIG. 20.
Figure 25:
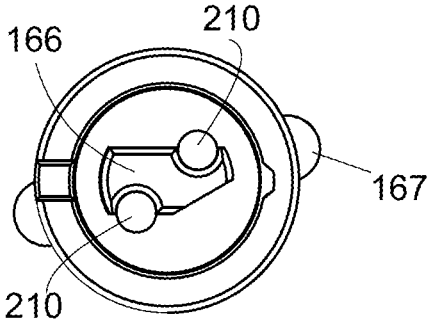
FIG. 25 illustrates a top view of the lock cylinder of FIG. 20.

FIG. 21 shows the lock cylinder when the balls are projecting out in relation to the outer surface of the outer cylinder. FIG. 26 show the same as a section view of the lock cylinder. The lock cylinder may also comprise a position form 2000 for locating the cylinder to a right position into the third cavity. FIG. 23 illustrates the cylinder lock in the state where it cannot be removed from the body 16A. When the control key is turned 30 degrees (in this embodiment) the bores are turned to be aligned with the holes and the balls, in which case the balls can move towards the center of the inner cylinder, and the lock cylinder can be removed. The pins 210 prevent the balls 167 to move entirely into the bores as FIG. 24 illustrates. Figure 25 shows the bottom holes for the pins. Also in this embodiment the longer leg of the shackle has a side cut 1616 along the leg.

The lock cylinder 161, 162 can be removed from the body 16A of the padlock even if the padlock is locked. This is possible just by turning the control key from the first position to the third position. The second cut 174 makes it possible to remove the lock cylinder when the pad lock is open. Otherwise the longer leg 168A prevents the turning the of cam member from the first position to the third position with the control key.

Figure 28:
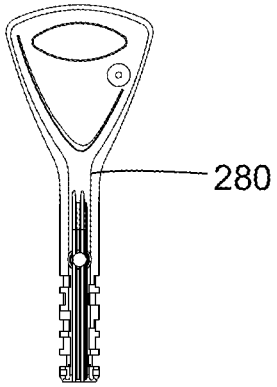
FIG. 28 illustrates an example of a key for the embodiment of FIG. 16.

FIG. 28 shows the first key 280 for the embodiment of FIG. 16. The second key differs from the first key in that it has at least different combination cuts for turning the key from the first position to the third position. As already said, the keys for the embodiment FIG. 1 are known as such.

So, the lock cylinder can be removed from the body, by turning the second key from the first position to the third position. Also in this embodiment, the lock can be opened first by turning to the second position and then turning to the other direction to the third position. So the second key can have the functionality of the first key. The lock cylinder can be placed into the body of the padlock, by doing the steps of the removal backwards. In other words, the clock cylinder is turned to the third position by the second key, pushed into the body, and then it is turned form the third position to the first position for keeping the lock cylinder in the body of the padlock.

As can be seen in the above embodiments the padlock according to the invention comprises latching parts for keeping the lock cylinder (and a possible second body) in the body in such a way that they can be opened for taking the lock cylinder from the body of the padlock. There exist other parts of the padlock to keep the cam member and locking balls in the body.

It is evident from the above that the invention is not limited to the embodiments described in this text but can be implemented in many other different embodiments within the scope of the claims.

The invention claimed is:

1. A padlock comprising a body, and a shackle that is moveable fixed to the body, the body having sockets for legs of the shackle, the padlock further comprising locking balls, first cavities for the locking balls, a cam member, a second cavity for the cam member, a lock cylinder and a third cavity for the lock cylinder, the locking balls being in the first cavities that are in connection with the sockets, the cam member in the second cavity being in connection with the locking balls and the lock cylinder in the third cavity, the cam member having unlocking cuts for the locking balls and a cylindrical basic form that has a first end and a second end, an inner part of the lock cylinder being turnable by a first key from a first position to a second position, and turnable by a control key from said first position to a third position, the lock cylinder being releasable from the body by turning the control key from the first position to the third position, wherein the cam member further comprises a circle groove on its surface in a vicinity of the first end providing a ridge at the first end, the unlocking cuts being parts of the circle groove, the cam member having also second cuts for the locking balls in the third position beside the unlocking cuts, installation grooves at the ridge, and a connection formation at the second end of the cam member, the cam member being in functional connection with the lock cylinder through the connection formation, the locking balls being in the circle groove and beside the ridge keeping the cam member in the second cavity even if the lock cylinder is released from the body.

2. A padlock according to claim 1, wherein the lock cylinder comprises an inner cylinder, being said inner part, and an outer cylinder, the outer cylinder having two holes, and the inner cylinder having a peripheral groove around its circle surface and two bores on the peripheral groove, the cylinder lock further comprising a counter formation for the connection formation and two balls in the peripheral groove, the counter folination being in connection with the inner cylinder, and the balls being between the inner cylinder and the outer cylinder, the third cavity having a second circle groove on its surface, the balls being in the holes of the outer cylinder and partly in the second circle groove when the inner cylinder is in the first position or in the second position, the balls being moveable to the bores away from the second circle groove when the lock cylinder is in the third position.

3. The padlock according to claim 1, wherein the installation grooves at the ridge are provided in order to install the cam member in the padlock.

4. A padlock according to claim 1, wherein the cylinder lock is turnable from the first position to the third position 25-40 degrees for releasing the lock cylinder from the body.

5. A padlock according to claim 2, wherein the padlock further comprises a second body that is accommodated in the third cavity of the body, the second body comprising a space for the lock cylinder and a slot on a side of the second body, the slot extending to the space, and being narrower than the space, the space and a part of the slot accommodating the lock cylinder, a part of the space accommodating the second end of the cam member that comprises side cuts so that the second end of the cam member fits into another part of the slot if the inner part of lock cylinder is turned from the first position to the third position, the inner part of the lock cylinder being functionally connected with the second end of the cam member.

6. A padlock according to claim 5, wherein the second body comprises a bore for one of the legs of the shackle.

7. A padlock according to claim 6, wherein the padlock comprises a connection part between the lock cylinder and the second end of the cam member, the connection part having a counter formation for the connection formation of the cam member.

8. A padlock according to claim 5, wherein the third cavity is open on a side of the body.

9. A padlock according to claim 8, wherein the third cavity has a side slot to a bottom of the body, and the second body has a side projection that fits to the side slot, the side projection comprising a hole for said keys.

10. A padlock according to claim 8, wherein the hole for the keys comprises shapes for providing turning areas for the keys.

11. A padlock according to claim 8, wherein the counter formation is a projection or a recess.

12. A padlock according to claim 8, wherein the longer leg of the shackle has a side cut along the leg.

13. A padlock according to claim 10, wherein the lock cylinder further comprises two pins and two installation holes on a bottom of the lock cylinder, the second holes extending from the bottom to the bores, the pins being through the second holes to the bores, the lock cylinder further comprising a plate covering at least partly the second holes and a fastener for fixing the plate with the bottom of the inner cylinder.

14. padlock according to claim 10, wherein the counter formation comprises recesses.

15. A padlock according to claim 10, wherein the inner cylinder further comprises a limiter ring for limiting rotation of the inner cylinder.

16. A padlock according to claim 8, wherein the longer leg of the shackle has a side cut along the leg.

* * * * *